US005670289A

United States Patent [19]

Hanzlik et al.

[11] Patent Number: 5,670,289

[45] Date of Patent: Sep. 23, 1997

[54] METHOD OF USING SCAVENGELESS DEVELOPER COMPOSITIONS

[75] Inventors: Cheryl A. Hanzlik, Fairport; Richard J. Hodgson, Rochester; Alexander J. Fioravanti, Penfield, all of N.Y.

[73] Assignee: Xerox Corporation, Stamford

[21] Appl. No.: 452,241

[22] Filed: May 26, 1995

[51] Int. Cl.[6] ..... G03G 13/20; G03G 13/16

[52] U.S. Cl. ..... 430/124; 430/110; 430/126

[58] Field of Search ..... 430/124, 110, 430/106, 103, 126

[56] References Cited

U.S. PATENT DOCUMENTS

| | | | |
|---|---|---|---|
| 3,590,000 | 6/1971 | Palermiti et al. | 252/62.1 |
| 3,900,588 | 8/1975 | Fisher | 427/19 |
| 4,078,929 | 3/1978 | Gundlach | 430/45 |
| 4,338,390 | 7/1982 | Lu | 430/106 |
| 4,433,040 | 2/1984 | Niimura et al. | 430/109 |
| 4,859,716 | 8/1989 | Ibsen et al. | 522/14 |
| 5,031,570 | 7/1991 | Hays et al. | 430/122 |
| 5,223,368 | 6/1993 | Ciccarelli et al. | 430/110 |
| 5,278,018 | 1/1994 | Young et al. | 430/110 |
| 5,370,962 | 12/1994 | Anderson et al. | 430/106 |

*Primary Examiner*—Christopher D. Rodee
*Attorney, Agent, or Firm*—E. O. Palazzo

[57] ABSTRACT

A method of imaging which comprises formulating an electrostatic latent image on an imaging member, affecting development thereof with a toner composition comprised of resin particles, and pigment particles, and which composition includes thereon a surface additive mixture of silica, or titanium dioxide, metal salts of fatty acids, and an aluminum complex, and thereafter transferring the developed image to a suitable substrate.

24 Claims, 2 Drawing Sheets

METHOD OF USING SCAVENGELESS DEVELOPER COMPOSITIONS

BACKGROUND OF THE INVENTION

The invention is generally directed to toner and developer compositions, and more specifically, the present invention is directed to imaging and printing methods with developer and toner compositions with acceptable developer conductivities, excellent toner charging properties, and $A_t$ stability, and wherein acceptable reloading of the toner on the donor means, such as a donor roll, can be accomplished, and wherein strobing of the development wires is eliminated or minimized. The developers of the present invention are particularly useful in hybrid scavengeless development systems, reference U.S. Pat. No. 5,032,872, the disclosure of which is totally incorporated herein by reference. In embodiments, the developers of the present invention can be selected for hybrid jumping development, hybrid scavengeless development, scavengeless development, and similar processes, reference U.S. Pat. Nos. 4,868,600; 5,010,367; 5,031,570; 5,119,147; 5,144,371; 5,172,170; 5,300,992; 5,311,258; 5,212,037; 4,984,019; 5,032,872; 5,134,442; 5,153,647; 5,153,648; 5,206,693; 5,245,392 and 5,253,016, the disclosures of which are totally incorporated herein by reference. Also, the developers of the present invention can be selected for trilevel xerography, reference U.S. Pat. Nos. 4,847,655; 4,771,314; 4,833,540; 4,868,608; 4,901,114; 5,061,969; 4,948,686 and 5,171,653, the disclosures of which are totally incorporated herein by reference, full color xerography, and the like, reference for example the Xerox Corporation 4850®. The toners of the present invention contain certain surface additives, and the developers thereof are comprised of toner and carrier particles.

Toner and developer compositions with wax and certain surface additives, such as silicas, KYNAR®, or metal oxides, are known. Illustrated, for example, in U.S. Pat. No. 3,900,588 is a toner with surface additive mixtures of silica or strontium titanate and polymers like KYNAR®, see column 7, lines 12 to 17. This patent discloses, for example, a toner with a minor amount of a polymeric additive like KYNAR®, and a minor amount of an abrasive material, such as silica, like AEROSIL R972®. Toners and developers with surface additives of metal salts of fatty acids like zinc stearate and silica are known, reference for example U.S. Pat. Nos. 3,983,045 and 3,590,000. In U.S. Pat. No. 4,789,613, there is illustrated a toner with an effective amount of, for example, strontium titanate dispersed therein, such as from about 0.3 to about 50 weight percent. Also disclosed in the '613 patent is the importance of the dielectric material with a certain dielectric constant, such as strontium titanate, being dispersed in the toner, and wherein the surface is free or substantially free of such materials. Further, this patent discloses the use of known charge controllers in the toner, see column 4, line 55, olefin polymer, see column 5, line 35, and a coloring agent like carbon black as a pigment. Treated silica powders for toners are illustrated in U.S. Pat. No. 5,306,588. Toners with waxes like polypropylene and polyethylene are, for example, illustrated in U.S. Pat. Nos. 5,292,609; 5,244,765; 4,997,739; 5,004,666 and 4,921,771, the disclosures of which are totally incorporated herein by reference. Magnetic toners with low molecular weight waxes and external additives of a first flow aid like silica and metal oxide particles are illustrated in U.S. Pat. No. 4,758,493, the disclosure of which is totally incorporated herein by reference. Examples of metal oxide surface additives are illustrated in column 5, at line 63, and include strontium titanate. Single component magnetic toners with silane treated magnetites are illustrated in U.S. Pat. No. 5,278,018, the disclosure of which is totally incorporated herein by reference. In column 8 of the '018 patent, there is disclosed the addition of waxes to the toner, and it is indicated that surface additives, such as AEROSIL®, metal salts of fatty acids and the like, can be selected for the toner.

Moreover, toners with charge additives are known. Thus, for example, there is described in U.S. Pat. No. 3,893,935 the use of quaternary ammonium salts as charge control agents for electrostatic toner compositions. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635, which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with aluminum, (BONTRON E-88®) chromium and cobalt complexes of azo dyes as negative charge enhancing additives. Further, TRH as a charge additive is illustrated in a number of patents, such as U.S. Pat. No. 5,278,018, the disclosure of which is totally incorporated herein by reference.

Disclosed in U.S. Pat. No. 5,482,805 and U.S. Pat. No. 5,486,443 , the disclosures of which are totally incorporated herein by reference, is a toner comprised of resin particles, magnetite, carbon black, rhodamine charge additive, low molecular weight wax with a weight average molecular weight of from about 1,000 to about 20,000, and a surface mixture comprised of three components of silica, or alumina, strontium titanate and polyvinylidene fluoride.

DESCRIPTION OF FIGURES

Illustrated in FIGS. 1 and 2 are line plots indicating the $A_r$ versus kiloprints for the Examples for process color hybrids scavengeless runs.

DETAILED DESCRIPTION OF THE FIGURES

Figure 1:
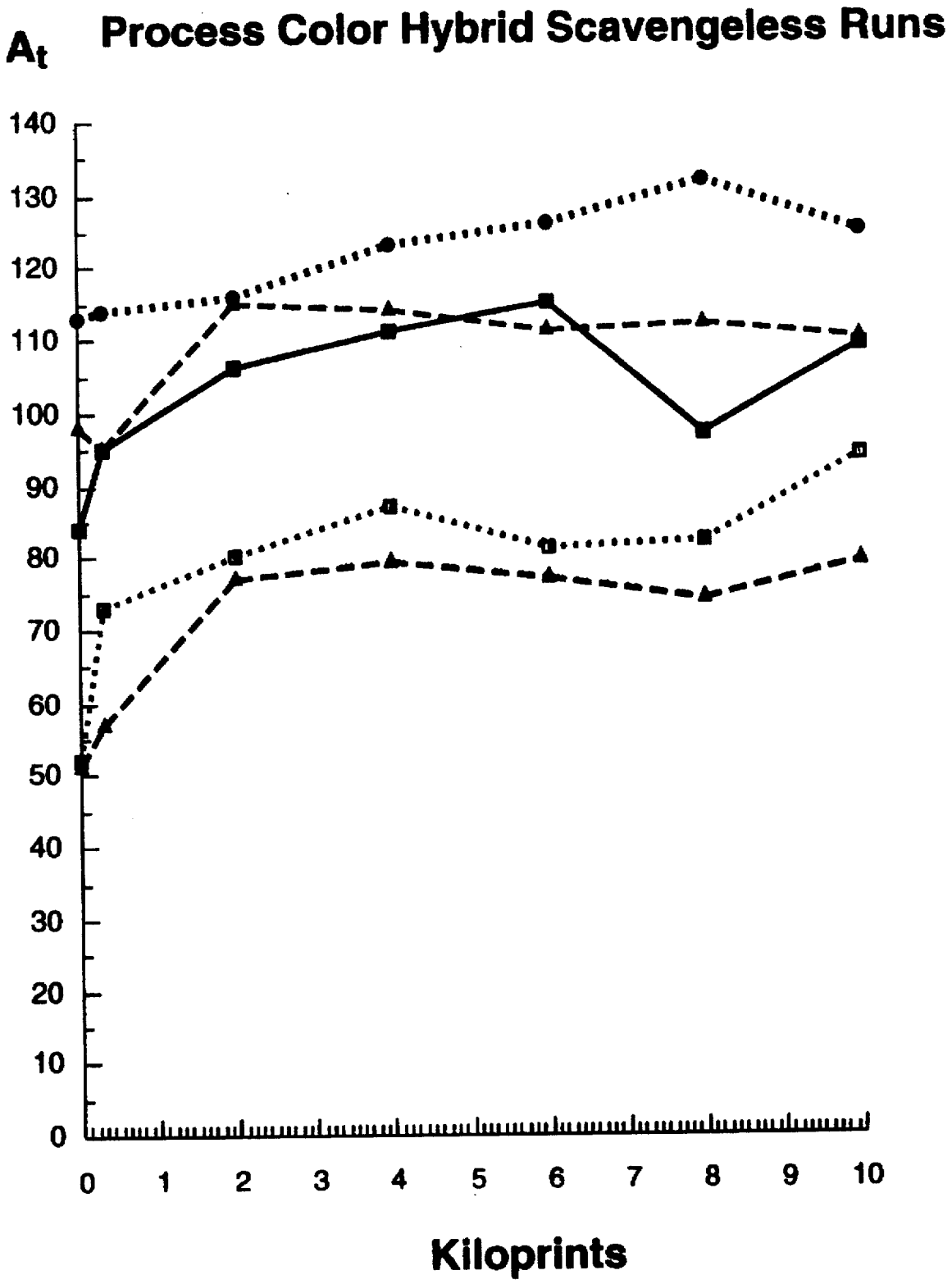
Figure 2:
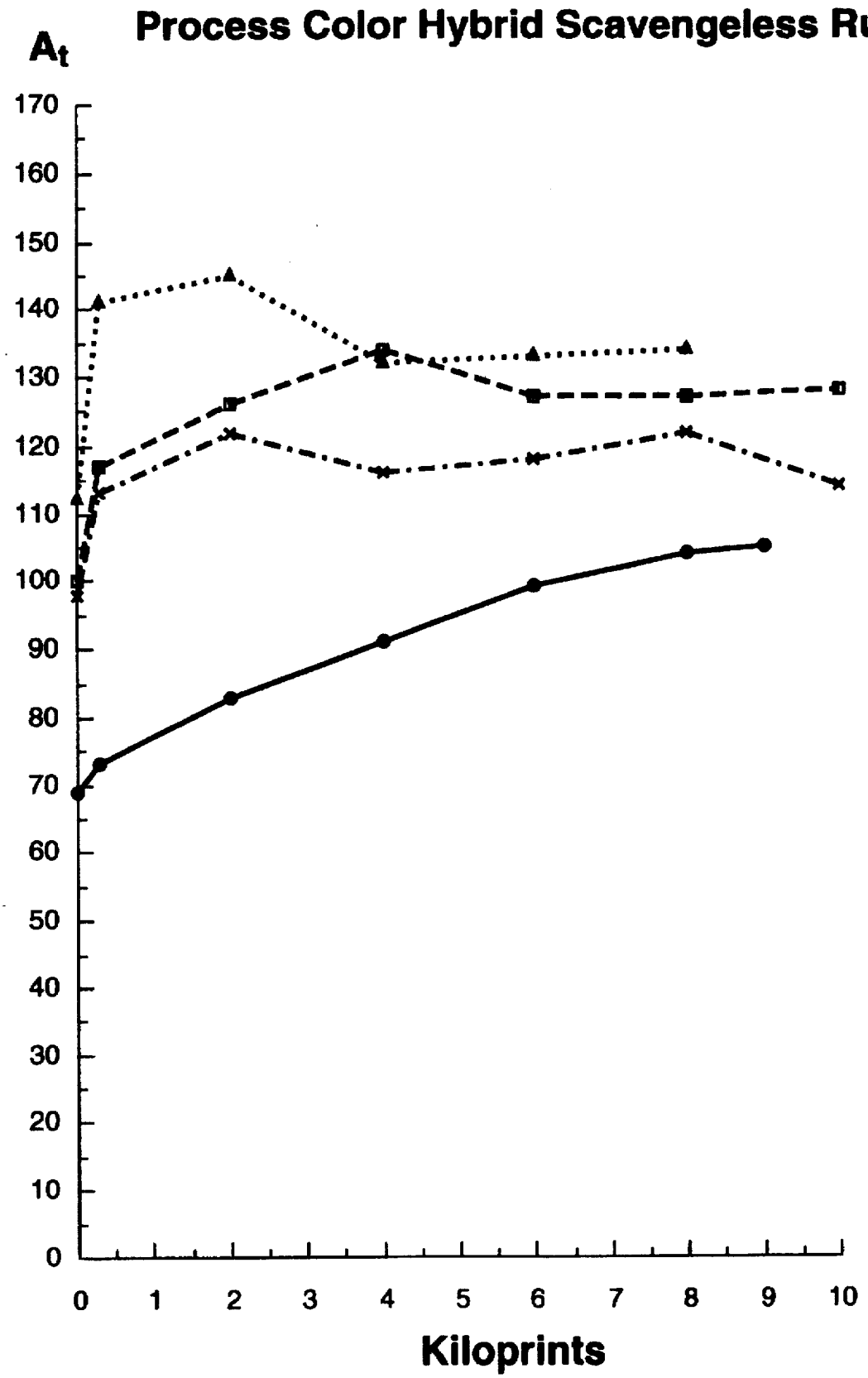

In FIG. 1, the solid, filled in circles represent the data for Example IIA; the triangles situated between the solid, filled in circles and the unfilled squares represent the data for Example IIIA; the squares represent the data for Example I; the unfilled squares represent the data for Example IIB, and the bottom line, that is with filled triangles, represents the data for Example IIIB. Similarly, in FIG. 2, the filled in triangles represent the data for Example VI, the unfilled squares represent the data for Example V, the x represents the data for Examle VII, and the filled circles represent the data for Example IV.

SUMMARY OF THE INVENTION

Examples of objects of the present invention include the following.

It is an object of the present invention to provide toner and developer compositions with many of the advantages illustrated herein.

In another object of the present invention there are provided toner compositions with a certain surface additive mixture, and which toners are substantially insensitive to relative humidity, possess excellent admix characteristics, stable $A_r$ properties, acceptable conductivity, excellent toner flow, and superior print quality with excellent resolution.

In yet another object of the present invention there are provided positive charged toner compositions with excellent admix, such as less than 15 seconds, and more specifically, from greater than zero to about 15 seconds, and excellent stable triboelectric characteristics.

In yet a further object of the present invention there are provided positively charged toners which admix in less than 15 seconds, that is, new toner added to developer in a Xerox Corporation hybrid scavengeless development test apparatus within 15 seconds or less, the charge and charge distribution of the added new toner, and with none or minimal increase in wrong sign, that is positively charged toner.

It is a further object of the present invention to provide toner and developer compositions which, when used in a hybrid scavengeless developing apparatus will exhibit excellent toner and developer flow characteristics for extended time periods of, for example, from about 800,000 to about 1,000,000 images.

In yet a further object of the present invention there are provided humidity insensitivity toners of from about, for example, 10 to 90 percent relative humidity at temperatures of from 60° F. to 80° F. as determined by operating a Xerox Corporation scavengeless imaging test fixture apparatus in a relative humidity testing chamber and toners that enable developed electrostatic images with excellent lines and solids that do not exhibit, or have minimal smudge or background.

Another object of the present invention resides in the provision of toners that can enable developed electrostatic images with excellent optical densities of, for example, at least about 1.4 and, more specifically, from about 1.3 to about 1.4, and which toners will enable the development of images in electrophotographic imaging apparatuses, which images have substantially no background deposits thereon, are substantially smudge proof or smudge resistant, and therefore, are of excellent resolution.

Further, in another important object of the present invention there are provided toners with a narrow $A_r$ of, for example, from about 60 to about 95 for extended print runs, such as for about 1,000,000 copies.

Additionally, in another important object of the present invention there are provided toners that are substantially humidity insensitive for an extended number of copies in a hybrid scavengeless imaging process.

Another important object of the present invention is the provision of toners with the combination of desired conductivity, excellent characteristics of rapid admix, superior flow, excellent optical density, humidity insensitivity, and a desired narrow and stable $A_r$.

In embodiments, the toners of the present invention are comprised of resin particles, pigment particles, especially colored other than black pigments, and optional waxes, and which toners contain surface additives comprised of a mixture of, for example, silica, especially fumed silicas, such as the AEROSILS® available from Degussa Chemicals, or titanium dioxide available as P25, from Degussa Chemicals; a metal salt of a fatty acid like zinc stearate; and an aluminum complex like BONTRON E-88® as the charge additive. More specifically, the present invention is directed to toner compositions, or particles comprised of resins, such as styrene methacrylates, styrene acrylates, styrene butadienes, polyesters, and the like, and preferably styrene butadienes, optional low molecular weight waxes, for example from about 500 to about 20,000 $M_w$ and preferably from about 1,000 to about 7,000 $M_w$ (weight average molecular weight); pigment particles of cyan, magenta, yellow, red, blue, green, or mixtures thereof; and a surface additive mixture of silica, especially fumed silicas, such as the AEROSILS® available from Degussa Chemicals, or titanium dioxide available as P25 from Degussa Chemicals; a metal salt of a fatty acid like zinc stearate; and the aluminum complex BONTRON E-88®.

Embodiments of the present invention include a method of imaging which comprises formulating an electrostatic latent image on an imaging member, affecting development thereof with a toner composition comprised of resin particles and pigment particles, and which composition includes thereon a surface additive mixture of silica, or titanium dioxide, metal salts of fatty acids, and an aluminum complex, and thereafter transferring the developed image to a suitable substrate; a method of imaging which comprises formulating an electrostatic latent image on a layered photoconductive imaging member, affecting development thereof with a colored toner composition comprised of resin particles and pigment particles of cyan, magenta, yellow, or mixtures thereof, and which composition includes thereon a surface additive mixture of silica, metal salts of fatty acids, and an aluminum complex, transferring the developed image to a suitable substrate, and fixing the image thereto; and a method of imaging which comprises formulating an electrostatic latent image on a layered photoconductive imaging member, affecting development thereof with a colored toner composition comprised of resin particles and pigment particles of cyan, magenta, yellow, or mixtures thereof, and which composition includes thereon a surface additive mixture of titanium dioxide, metal salts of fatty acids, and an aluminum complex, transferring the developed image to a suitable substrate, and fixing the image thereto.

Examples of resin particles present in various effective important amounts, such as from about 50 to about 95 and preferably from about 80 to about 90 and more preferably about 90 weight percent in embodiments, include styrene butadiene copolymers, such as PLIOTONE®, and wherein the styrene is present, for example, in an amount of from about 60 to about 95 weight percent and the butadiene is present in an amount of from about 5 to about 30 weight percent, and wherein the preferred ranges are from 80 to 90 weight percent of styrene and 10 to 20 weight percent of butadiene. These resins and certain polyesters provide toners that exhibit, for example, no, or minimal toner developed vinyl offset. Resin examples include copolymers of styrene and isoprene wherein the isoprene is present in an amount of from 10 weight percent to 16 weight percent; styrene copolymerized with one, two or more of the monomers methyl methacrylate, ethyl methacrylate, butyl methacrylate, isobutyl methacrylate, hexyl methacrylate, 2-ethyl hexyl methacrylate, or mixtures thereof; polyamides and polyimides.

Illustrative examples of suitable toner resins selected for the toner and developer compositions of the present invention include polyamides, polyolefins, styrene acrylates, styrene methacrylate, styrene butadienes, crosslinked styrene polymers, epoxies, polyurethanes, vinyl resins including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide, mixtures thereof, and the like; and styrene butadiene copolymers with a styrene content of from about 70 to about 95 weight percent, reference the U.S. patents mentioned herein, the disclosures of which have been totally incorporated herein by reference. In addition, crosslinked resins including polymers, copolymers, homopolymers of the aforementioned styrene polymers may be selected. As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES™; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof.

Illustrative examples of colored pigments include magenta materials such as, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like; cyan pigments of copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; and yellow pigments of diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In embodiments, these colored pigment particles are present in the toner composition in an amount of from about 1 percent by weight to about 15 percent by weight, and preferably from about 2 to about 10 weight percent calculated on the weight of the toner resin particles.

Optional waxes with a molecular weight of from about 500 to about 20,000, such as polyethylene, polypropylene, reference for example British Patent Publication 1,442,835, the disclosure of which is totally incorporated herein by reference, and paraffin waxes can be included in, or on the toner compositions in embodiments of the present invention primarily as fuser roll release agents and to avoid or minimize offset of the toner to paper. Examples of preferred waxes include VISCOL 550® and 660P® available from Sanyo of Japan, and crystalline polyethylene wax with a weight average molecular weight of from about 1,000 to about 3,000 like POLYWAX 1,000®, 2,000® and 3,000® as obtained from the Petrolite Corporation. Other suitable waxes can be Shamrock Chemicals Ceralube 363, Super Taber 5509, WEGO GT8520, and the like. Functionalized alcohol waxes such as Petrolite Corporation UNILIN 425®, UNILIN 550® and UNILIN 700® also can be selected, see U.S. Pat. No. 4,883,736, the disclosure of which is totally incorporated herein by reference. These waxes are present in various important effective amounts such as, for example, from about 3 to about 9 percent and preferably from about 4.5 to about 6 weight percent.

The external surface additive mixture include fumed silicas, such as AEROSIL®, or titanium dioxides; metal salts of fatty acids; and aluminum complexes, such as BONTRON E-88®, the aluminum complex tris (3,5-di-tertiary-butylsalicylato) aluminum, BONTRON E-84®, available from Hodogaya Chemicals of Japan, and the like.

Each of the three surface additives is present on the toner in important amounts, that is from about 0.01 to about 2.0, the amounts in embodiments depending primarily on the pigment selected. In embodiments, for a cyan toner about 0.3 weight percent of zinc stearate is present, about 0.3 weight percent of silica like AEROSIL R972® available from Degussa Chemicals, or 0.9 weight percent of P25 titanium dioxide is present, and 0.05 weight percent of BONTRON E-88® is present; for a magenta toner, about 0.4 weight percent of zinc stearate is present, about 0.4 weight percent of silica like AEROSIL R972® available from Degussa Chemicals, or 0.9 weight percent of P25 titanium dioxide is present, and 0.1 weight percent of BONTRON E-88® is present; for a yellow toner, about 0.3 weight percent of zinc stearate is present, about 0.3 weight percent of silica like AEROSIL R972® available from Degussa Chemicals, or 0.9 weight percent of P25 titanium dioxide is present, and 0.05 weight percent of BONTRON E-88® is present.

The toner compositions of the present invention can be prepared by known melt blending processes, or by extrusion, and are usually jetted and classified subsequently to enable toner particles with a preferred average volume diameter of from about 5 to about 25 microns, and more preferably from about 8 to about 12 microns.

For the formulation of developer compositions, there are mixed with the toner particles of the present invention carrier components, particularly those that are capable of triboelectrically assuming an opposite polarity to that of the toner composition. Accordingly, the carrier particles of the present invention can be selected to be of a negative or positive polarity enabling the toner particles, which are positively or negatively charged, to adhere to and surround the carrier particles. Illustrative examples of carrier particles include iron powder, steel, nickel, iron, ferrites, including copper zinc ferrites, magnetic iron oxides, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances, such as carbon black, in an amount of from about 5 to about 30 percent by weight. Preferred are polymer coatings not in close proximity in the triboelectric series, reference U.S. Pat. Nos. 4,937,166 and 4,935,326, the disclosures of which are totally incorporated herein by reference, including, for example, KYNAR® and polymethylmethacrylate mixtures (40/60 to 55/45). Coating weights can vary as indicated herein; generally, however, from about 0.3 to about 2, and preferably from about 0.4to about 1.5 weight percent coating weight is selected. The carrier in embodiments is preferably comprised of Hoeganese unoxidized core, 98 microns, solution coated with about 1 percent of an 80/20 lacquer of polymethylmethacrylate/VULCAN 72R® carbon black obtained from Cabot Corporation.

Furthermore, the diameter of the carrier particles, preferably nonspherical in shape, is generally from about 50 microns to about 1,000 microns and preferably from about 75 to about 100 microns, thereby permitting them to possess sufficient density and inertia to avoid adherence to the electrostatic images during the development process. The carrier component can be mixed with the toner composition in various suitable combinations, such as for example 1 to 6 parts per toner to about 100 parts to about 200 parts by weight of carrier.

The toner of the present invention may be selected for use in electrostatographic imaging apparatuses, especially hybrid scavengeless and trilevel xerography as indicated herein, and containing therein conventional photoreceptors including layered photoconductive imaging members. Thus, the toner and developer compositions of the present invention can be used with layered photoreceptors, reference U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys; amorphous silicon; layered members comprised of photogenerating components like selenium; and charge transport molecules like aryldiamines, reference U.S. Pat. Nos. 4,265,990, 4,585,884; 4,584,253 and 4,563,408, the disclosures of which are totally incorporated herein by reference. For the layered flexible imaging members, photogenerating components include selenium, trigonal selenium, selenium alloys, phthalocyanines and charge transport layers of aryl amines as illustrated in U.S. Pat. No. 4,265,990.

The toner triboelectric charge for the toners of the present invention in embodiments of from about −15 to about −25 as determined by the known Faraday Cage method, and the developer conductivity is, for example, less than or equal to about $10^{-13}$ (ohm-cm)$^{-1}$and, more specifically, is from about $10^{-7}$ to $10^{-10}$ (ohm-cm)$^{-1}$, as determined by the Gutman Cell, reference U.S. Pat. No. 5,196,803, the disclosure of which is totally incorporated herein by reference, at, for example, a 3 to 4 percent toner concentration.

The following Examples are being supplied to further define various species of the present invention, it being noted that these Examples are intended to illustrate and not limit the scope of the present invention. Parts and percentages are by weight unless otherwise indicated. Comparative information is also provided. The values $A_r$ were determined from the following calculation, that is the product of one plus the toner concentration (TC) multiplied by the charge Q/M, for example 23 microcoulombs per gram.

$$A_r=(1+TC)Q/M$$

EXAMPLE I

There was prepared a toner by melt blending an extruder ZSK-53, followed by mechanical attrition, which toner contained 96 percent by weight of a styrene butadiene copolymer containing 90 percent by weight of styrene and 10 percent by weight of butadiene obtained from Goodyear Chemicals Corporation as PLIOTONE®, and 2.9 percent by weight of FANAL PINK™, and 1.1 percent of BONTRON E-88®. Micronization in a Sturtevant micronizer enabled toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns. The resulting toner particles obtained had an average volume size, or diameter of 11 microns.

Subsequently, there was added to the resulting toner particles surface by blending in a Lodige blender 0.4 percent by weight of Degussa AEROSIL R972® hydrophobic negatively charging silica, 0.4 percent by weight of zinc stearate, and 0.1 percent (by weight throughout unless otherwise indicated) of BONTRON E-88®.

About four parts of the above prepared toner and 100 parts of carrier were admixed to provide a developer. The carrier particles were comprised of a 98 micron Hoeganese unoxidized steel grit core solution coated with 1.06 weight percent of an 80/20 (80 weight percent, and 20 weight percent) lacquer of polymethylmethacrylate/VULCAN 72R® carbon black.

The toner triboelectric charge was a negative −19 microcoulombs per gram at 2.98 toner concentration or as determined by the known Faraday Cage method. The developer conductivity was $5.4\times10^{-10}$ (ohm-cm)$^{-1}$ and $1.4\times10^{-6}$ (ohm-cm)$^{-1}$ for detoned carrier as determined by the Gutman Cell, reference U.S. Pat. No. 5,196,803, the disclosure of which is totally incorporated herein by reference. The developer alpha, reference U.S. Pat. No. 4,513,074, entitled Stable Conductive Developer Compositions, was an acceptable 2.7. It is preferred that alpha be small, for example 5 or less, and more preferably 1 to about 3. The toner admix was 15 seconds as determined in the known charge spectrograph.

The aforementioned developer composition was utilized to develop latent images generated in a Xerox Corporation hybrid scavengeless test printer apparatus at a rate of 135 prints per minute, followed by the transfer of the developed images from a layered organic flexible photoreceptor comprised of an aluminum substrate, thereover a photogenerating layer comprised of a photogenerating pigment of trigonal selenium, and as a top layer a charge transport layer comprised of aryl diamine molecules of N,N'-bis(3"-methylphenyl)-1,1'-biphenyl-4,4'-diamine dispersed in MAKROLON®, a polycarbonate resin obtained from Larbensabricken Bayer A. G., prepared as disclosed in U.S. Pat. No. 4,265,990, the disclosure of which is totally incorporated herein by reference, to a paper substrate, and the images were fused to paper for 10,000 copies, each with from 4 to 30 percent area coverage. The developer charging properties remained essentially constant throughout the test, as determined by periodic measurements of toner triboelectric charge and toner concentration in the developer. The values of, for example, $A_r$ remained constant, about 100, throughout this test as determined from the following calculation, that is the product of one plus the toner concentration (TC) multiplied by the charge Q/M, for example 23 microcoulombs per gram.

$$A_r=(1+TC)Q/M$$

The fused images were of excellent quality, and possessed high optical densities of greater than 1.3 (solid area image optical density) as measured on a Macbeth Densitometer, and very low development of toner in background areas, that is minimum background deposits. Periodic visual microscopic inspection of the photoreceptor indicated no evidence of toner impacting onto the wires, such as in small streaks of one millimeter or less, that is there was an absence of undesirable wire contamination for the 10,000 print run. Further, there was an absence of negative ghosting (donor roll reload defect) in the prints showing a maintenance of acceptable developer conductivity during the print run. At the end of the print run, the conductivity was 1.1 E-11 and alpha was 2.9.

EXAMPLE II

There was prepared a toner by melt blending an extruder ZSK-53, followed by mechanical attrition, which toner contained 94 percent by weight of a styrene butadiene copolymer containing 90 percent by weight of styrene and 10 percent by weight of butadiene obtained from Goodyear Chemicals Corporation as PLIOTONE®, and 5 percent of NOVAPERM YELLOW FGL™, and 1 percent of distearyl dimethyl ammonium methyl sulfate (DDAMS). Micronization in a Sturtevant micronizer enabled toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns. The resulting toner particles obtained had an average volume size, or diameter of 11 microns.

Subsequently, there was added to the resulting toner particles surface by blending in a Lodige blender, (IIa) 0.3 percent by weight of Degussa AEROSIL R972® hydrophobic negatively charging silica, 0.3 percent by weight of zinc stearate, and 0.05 percent BONTRON E-88®or (II b) 0.9 percent by weight of Degussa P25 titanium dioxide, 0.3 percent by weight of zinc stearate, and 0.05 percent of BONTRON E-88®.

About four parts of the above prepared toner and 100 parts of carrier were admixed to provide a developer. The carrier particles were comprised of a 98 micron Hoeganese unoxidized steel grit core solution coated with 1.06 weight percent of an 80/20 (80 weight percent, and 20 weight percent) lacquer of polymethylmethacrylate/VULCAN 72R® carbon black.

The toner triboelectric charge was a (II a) negative −25 microcoulombs per gram at 2.96 toner concentration, or (II b) negative −11 microcoulombs per gram at 2.93 toner concentration, as determined by the known Faraday Cage method. The developer conductivity was (II a) 3.7 E-8 $(ohm\text{-}cm)^{-1}$ and $9.3\times10^{-7}$ $(ohm\text{-}cm)^{-1}$ for detoned carrier, or (II b) 2.5 E-9 $(ohm\text{-}cm)^{-1}$ and $1.6\times10^{-6}$ $(ohm\text{-}cm)^{-1}$ for detoned carrier as determined by the Gutman Cell, reference U.S. Pat. No. 5,196,803, the disclosure of which is totally incorporated herein by reference. The developer alpha, reference U.S. Pat. No. 4,513,074, entitled Stable Conductive Developer Compositions, was a (II a) 1.2 or (II b) 2.2. It is preferred that alpha be small, for example 5 or less, and more preferably 1 to about 3. The toner admix was 15 seconds as determined in the known charge spectrograph.

The aforementioned developer composition was utilized to develop latent images generated in a Xerox Corporation hybrid scavengeless test printer apparatus at a rate of 135 prints per minute, followed by the transfer of the developed images from a layered organic flexible photoreceptor comprised of an aluminum substrate, thereover a photogenerating layer comprised of a photogenerating pigment of trigonal selenium, and as a top layer a charge transport layer comprised of aryl diamine molecules of N,N'-bis(3"-methylphenyl)-1,1'-biphenyl-4,4'-diamine dispersed in MAKROLON®, a polycarbonate resin obtained from Larbensabricken Bayer A. G., prepared as disclosed in U.S. Pat. No. 4,265,990, the disclosure of which is totally incorporated herein by reference, to a paper substrate, and the images were fused to paper for 10,000 copies, each with from 4 to 30 percent area coverage. The developer charging properties remained essentially constant throughout the test, as determined by periodic measurements of toner triboelectric charge and toner concentration in the developer. The values of, for example, $A_r$ remained constant, about (II a) 120 or (II b) 80, throughout this test as determined from the following calculation, that is the product of one plus the toner concentration (TC) multiplied-by the charge Q/M, for example 23 microcoulombs per gram.

$$A_r=(1+TC)Q/M$$

The fused images were of excellent quality, and possessed high optical densities of greater than 1.3 (solid area image optical density) as measured on a Macbeth Densitometer, and very low development of toner in background areas, that is minimum background deposits. Periodic visual microscopic inspection of the photoreceptor indicated no evidence of toner impacting onto the wires, such as in small streaks of one millimeter or less, that is there was an absence of undesirable wire contamination for the 10,000 print run. Further, there was an absence of negative ghosting (Donor roll reload defect) in the prints showing a maintenance of acceptable developer conductivity during the print run. At the end of the run, the conductivity and alphas were (II a) cond=1.4 E-13, and alpha was 2.7 or (II b) cond=5.5 E-10 and alpha was 3.7.

EXAMPLE III

There was prepared a toner by melt blending an extruder ZSK-53, followed by mechanical attrition, which toner contains 97 percent by weight of a styrene butadiene copolymer containing 90 percent by weight of styrene, and 10 percent by weight of butadiene obtained from Goodyear Chemicals Corporation as PLIOTONE®, and 2.0 percent by weight of PV FAST BLUE™, and 1.0 percent of distearyl dimethyl ammonium methyl sulfate. Micronization in a Sturtevant micronizer enabled toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns. The resulting toner particles obtained had an average volume size, or diameter of 11 microns.

Subsequently, there was added to the resulting toner particles surface by blending in a Lodige blender (III a) 0.3 percent by weight of DegussaAEROSIL R972® hydrophobic negatively charging silica, 0.3 percent by weight of zinc stearate, and 0.05 percent of BONTRON E-88®, or (III b) 0.9 percent by weight of Degussa P25 titanium dioxide, 0.3 percent by weight of zince stearate, and 0.05 percent of BONTRON E-88®.

About four parts of the above prepared toner and 100 parts of carrier were admixed to provide a developer. The carrier particles were comprised of a 98 micron Hoeganese unoxidized steel grit core solution coated with 1.06 weight percent of an 80/20 (80 weight percent, and 20 weight percent) lacquer of polymethylmethacrylate/VULCAN 72R® carbon black.

The toner triboelectric charge was a negative (III a) -24 microcoulombs per gram at 2.94 toner concentration, or (III b) -13 microcoulombs per gram at 2.71 toner concentration as determined by the known Faraday Cage method. The developer conductivity was (III a) $1.2\times10^{-10}$ $(\text{ohm-cm})^{-1}$ and $8.5\times10^{-7}$ $(\text{ohm-cm})^{-1}$ for detoned carrier, or (III b) $1.1\times10^{-9}$ $(\text{ohm-cm})^{-1}$ and $1.6\times10^{-6}$ $(\text{ohm-cm})^{-1}$ for detoned carrier as determined by the Gutman Cell, reference U S. Pat. No. 5,196,803, the disclosure of which is totally incorporated herein by reference. The developer alpha, reference U.S. Pat. No. 4,513,074, entitled Stable Conductive Developer Compositions, was an acceptable (III a) 3.2 or (III b) 2.7. It is preferred that alpha be small, for example 5 or less, and more preferably 1 to about 3. The toner admix was 15 seconds as determined in the known charge spectrograph.

The aforementioned developer composition was utilized to develop latent images generated in a Xerox Corporation hybrid scavengeless test printer apparatus at a rate of 135 prints per minute, followed by the transfer of the developed images from a layered organic flexible photoreceptor comprised of an aluminum substrate, thereover a photogenerating layer comprised of a photogenerating pigment of trigonal selenium, and as a top layer a charge transport layer comprised of aryl diamine molecules of N,N'-bis(3"-methylphenyl)-1,1'-biphenyl-4,4'-diamine dispersed in MAKROLON®, a polycarbonate resin obtained from Larbensabricken Bayer A. G., prepared as disclosed in U.S. Pat. No. 4,265,990, the disclosure of which is totally incorporated herein by reference, to a paper substrate, and the images were fused to paper for 10,000 copies, each with from 4 to 30 percent area coverage. The developer charging properties remained essentially constant throughout the test, as determined by periodic measurements of toner triboelectric charge and toner concentration in the developer. The values of, for example, $A_r$ remained constant, about (III a) 110 or (III b) 75, throughout this test as determined from the following calculation, that is the product of one plus the toner concentration (TC) multiplied by the charge Q/M, for example 23 microcoulombs per gram.

$$A_r=(1+TC)Q/M$$

The fused images were of excellent quality, and possessed high optical densities of greater than 1.3 (solid area image optical density) as measured on a Macbeth Densitometer, and very low development of toner in background areas, that is minimum background deposits. Periodic visual microscopic inspection of the photoreceptor indicated no evidence of toner impacting onto the wires, such as in small streaks of one millimeter or less, that is there was an absence of undesirable wire contamination for the 10,000 print run. Further, there was an absence of negative ghosting (donor roll reload defect) in the prints showing a maintenance of acceptable developer conductivity during the print run. The conductivity at the end ofthe print run was (III a) 3.1 E-12 or (III b) 1.2 E-10, and alpha was (III a) 4.2 or (III b) 1.5.

EXAMPLE IV

There was prepared a toner by melt blending an extruder ZSK-53, followed by mechanical attrition, which toner contained 92.5 percent by weight of a styrene butadiene copolymer containing 90 percent by weight of styrene and 10 percent by weight of butadiene obtained from Goodyear Chemicals Corporation as PLIOTONE®, and 5.0 percent by weight of Cabot REGAL 330®, 0.5 percent of dimethyl distearyl ammonium acetate, and 2.0 percent of BONTRON E-84®. Micronization in a Sturtevant micronizer enabled toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns. The resulting toner particles obtained had an average volume size, or diameter of 9 microns.

Subsequently, there was added to the resulting toner particles surface by blending in a Lodige blender 0.9 percent by weight of Degussa P25 Titania, and 0.4 percent by weight of zinc stearate.

About three parts of the above prepared toner and 100 parts of carrier were admixed to provide a developer. The carrier particles were comprised of a 98 micron Hoeganese unoxidized steel grit core solution coated with 1.06 weight percent of an 80/20 (80 weight percent, and 20 weight percent) lacquer of polymethylmethacrylate/VULCAN 72R® carbon black.

The toner triboelectric charge was a negative −14 microcoulombs per gram at 2.85 toner concentration as determined by the known Faraday Cage method. The developer breakdown potential in volts was 40, and for detoned carrier the breakdown voltage was 24; the developer conductivity was $7.0\times10^{-10}$ $(\text{ohm-cm})^{-1}$ and $7.3\times10^{-5}$ $(\text{ohm-cm})^{-1}$ for detoned carrier as determined by the Gutman Cell, reference U.S. Pat. No. 5,196,803, the disclosure of which is totally incorporated herein by reference. The developer alpha, reference U.S. Pat. No. 4,513,074, entitled Stable Conductive Developer Compositions, was an acceptable 2.7. It is preferred that alpha be small, for example 5 or less, and more preferably 1 to about 3. The toner admix was 15 seconds as determined in the known charge spectrograph.

The aforementioned developer composition was utilized to develop latent images generated in a Xerox Corporation hybrid scavengeless test printer apparatus at a rate of 135 prints per minute, followed by the transfer of the developed images from a layered organic flexible photoreceptor comprised of an aluminum substrate, thereover a photogenerating layer comprised of a photogenerating pigment of trigonal selenium, and as a top layer a charge transport layer comprised of aryl diamine molecules of N,N'-bis(3"-methylphenyl)-1,1'-biphenyl-4,4'-diamine dispersed in MAKROLON®, a polycarbonate resin obtained from Larbensabricken Bayer A. G., prepared as disclosed in U.S. Pat. No. 4,265,990, the disclosure of which is totally incorporated herein by reference, to a paper substrate, and the images were fused to paper for 10,000 copies, each with from 4 to 30 percent area coverage. The developer charging properties remained essentially constant throughout the test, as determined by periodic measurements of toner triboelectric charge and toner concentration in the developer. The values of, for example, $A_r$ remained constant, about 100, throughout this test as determined from the following calculation, that is the product of one plus the toner concentration (TC) multiplied by the charge Q/M, for example 23 microcoulombs per gram.

$$A_r=(1+TC)Q/M$$

The fused images were of excellent quality, and possessed high optical densities of greater than 1.3 (solid area image optical density) as measured on a Macbeth Densitometer and very low development of toner in background areas, that is minimum background deposits. Periodic visual microscopic inspection of the photoreceptor indicated no evidence of toner impacting onto the wires, such as in small streaks of one millimeter or less, that is there was an absence of undesirable wire contamination for the 10,000 print run. Further, there was an absence of negative ghosting (donor roll reload defect) in the prints showing a maintenance of acceptable developer conductivity during the print run. The conductivity at the end of the print run was 1.2 E-10 and alpha was 3.1.

EXAMPLE V

There was prepared a toner by melt blending an extruder ZSK-53, followed by mechanical attrition, which toner contained 93.5 percent by weight of a styrerie butadiene copolymer containing 90 percent by weight of styrene and 10 percent by weight of butadiene obtained from Goodyear Chemicals Corporation as PLIOTONE®, 5.0 percent by weight of Cabot REGAL 330®, 0.5 percent by weight of distearyl dimethyl ammonium methyl sulfate, and 1.0 percent of BONTRON E-88®. Micronization in a Sturtevant micronizer enabled toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns. The resulting toner particles obtained had an average volume size, or diameter of 9 microns.

Subsequently, there was added to the resulting toner particles surface by blending in a Lodige blender, 0.3 percent by weight of Degussa AEROSIL R972® hydrophobic negatively charging silica, and 0.3 percent by weight of zinc stearate.

About three parts of the above prepared toner and 100 parts of carrier were admixed to provide a developer. The carrier particles were comprised of a 98 micron Hoeganese unoxidized steel grit core solution coated with 1.06 weight percent of an 80/20 (80 weight percent, and 20 weight percent) lacquer of polymethylmethacrylateNULCAN 72R® carbon black.

The toner triboelectric charge was a negative −23 microcoulombs per gram at 2.77 toner concentration as determined by the known Faraday Cage method. The developer conductivity was $8.6\times10^{-11}$ $(\text{ohm-cm})^{-1}$ and $6.3\times10^{-7}$ $(\text{ohm-cm})^{-1}$ for detoned carrier as determined by the Gutman Cell, reference U.S. Pat. No. 5,196,803, the disclosure of which is totally incorporated herein by reference. The developer alpha, reference U.S. Pat. No. 4,513,074, entitled Stable Conductive Developer Compositions, was an acceptable 3.6. It is preferred that alpha be small, for example 5 or less, and more preferably 1 to about 3. The toner admix was 15 seconds as determined in the known charge spectrograph.

The aforementioned developer composition was utilized to develop latent images generated in a Xerox Corporation hybrid scavengeless test printer apparatus at a rate of 135 prints per minute, followed by the transfer of the developed images from a layered organic flexible photoreceptor comprised of an aluminum substrate, thereover a photogenerating layer comprised of a photogenerating pigment of trigonal selenium, and as a top layer a charge transport layer comprised of aryl diamine molecules of N,N'-bis(3"-methylphenyl)-1,1'-biphenyl-4,4'-diamine dispersed in MAKROLON®, a polycar-bonate resin obtained from Larbensabricken Bayer A. G., prepared as disclosed in U.S. Pat. No. 4,265,990, the disclosure of which is totally incorporated herein by reference, to a paper substrate, and the images were fused to paper for 10,000 copies, each with from 4 to 30 percent area coverage. The developer charging properties remained essentially constant throughout the test, as determined by periodic measurements of toner triboelectric charge and toner concentration in the developer. The values of, for example, $A_r$ remained constant, about 130, throughout this test as determined from the following calculation, that is the product of one plus the toner concentration (TC) multiplied by the charge Q/M, for example 23 microcoulombs per gram.

$$A_r=(1+TC)Q/M$$

The fused images were of excellent quality, and possessed high optical densities of greater than 1.3 (:solid area image optical density) as measured on a Macbeth Densitometer, and very low development of toner in background areas, that is minimum background deposits. Periodic visual microscopic inspection of the photoreceptor indicated no evidence of toner impacting onto the wires, such as in small streaks of one millimeter or less, that is there was an absence of undesirable wire contamination for the 10,000 print run. Further, there was negligible negative ghosting (donor roll reload defect) in the prints showing a maintenance of acceptable developer conductivity during the print run. At the end of the print run, the conductivity was 1.0 E-14 and alpha was 3.2.

EXAMPLE VI

There was prepared a toner by melt blending an extruder ZSK-53, followed by mechanical attrition, which toner contains 92.5 percent by weight of a styrene butadiene copolymer containing 90 percent by weight of styrene and 10 percent by weight of butadiene obtained from Goodyear Chemicals Corporation as PLIOTONE®, 5.0 percent by weight of Cabot REGAL 330® carbon black, 2.0 percent by weight of TRH, and 0.5 percent by weight of CPC. Micronization in a Sturtevant micronizer enabled toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns. The resulting toner particles obtained had an average volume size, or diameter of 9 microns.

Subsequently, there was added to the resulting toner particles surface by blending in a Lodige blender 0.3 percent by weight of Degussa AEROSIL R972® hydrophobic negatively charging silica, and 0.3 percent by weight of zinc stearate.

About three parts of the above prepared toner and 100 parts of carrier were admixed to provide a developer. The carrier particles were comprised of a 98 micron Hoeganese unoxidized steel grit core solution coated with 1.06 weight percent of an 80/20 (80 weight percent, and 20 weight percent) lacquer of polymethylmethacrylate/VULCAN 72R® carbon black.

The toner triboelectric charge was a negative −23 microcoulombs per gram at 3.09 toner concentration as determined by the known Faraday Cage method. The developer conductivity was $2.9\times10^{-10}$ (ohm-cm)$^{-1}$ and $2.7\times10^{-6}$ (ohm-cm)$^{-1}$ for detoned carrier as determined by the Gutman Cell, reference U.S. Pat. No. 5,196,803, the disclosure of which is totally incorporated herein by reference. The developer alpha, reference U.S. Pat. No. 4,513,074, entitled Stable Conductive Developer Compositions, was an acceptable 2.8. It is preferred that alpha be small, for example 5 or less, and more preferably 1 to about 3. The toner admix was 15 seconds as determined in the known charge spectrograph.

The aforementioned developer composition was utilized to develop latent images generated in a Xerox Corporation hybrid scavengeless test printer apparatus at a rate of 135 prints per minute, followed by the transfer of the developed images from a layered organic flexible photoreceptor comprised of an aluminum substrate, thereover a photogenerating layer comprised of a photogenerating pigment of trigonal setenium, and as a top layer a charge transport layer comprised of aryl diamine molecules of N,N'-bis(3"-methylphenyl)-1,1'-biphenyl-4,4'-diamine dispersed in MAKROLON®, a polycarbonate resin obtained from Larbensabricken Bayer A. G., prepared as disclosed in U.S. Pat. No. 4,265,990, the disclosure of which is totally incorporated herein by reference, to a paper substrate, and the images were fused to paper for 10,000 copies, each with from 4 to 30 percent area coverage. The developer charging properties remained essentially constant throughout the test, as determined by periodic measurements of toner triboelectric charge and toner concentration in the developer. The values of, for example, $A_r$ remained constant, about 135, throughout this test as determined from the following calculation, that is the product of one plus the toner concentration (TC) multiplied by the charge Q/M, for example 23 microcoulombs per gram.

$$A_r=(1+TC)Q/M$$

The fused images were of excellent quality, and possessed high optical densities of greater than 1.3 (solid area image optical density) as measured on a Macbeth Densitometer, and very low development of toner in background areas, that is minimum background deposits. Periodic visual microscopic inspection of the photoreceptor indicated no evidence of toner impacting onto the wires, such as in small streaks of one millimeter or less, that is there was an absence of undesirable wire contamination for the 10,000 print run. Further, there was negligible negative ghosting (donor roll reload defect) in the prints showing a maintenance of acceptable developer conductivity during the print run. The conductivity was 9.5 E-12 and alpha was 3.4 at end of the print run.

EXAMPLE VII

There was prepared a toner by melt blending an extruder ZSK-53, followed by mechanical attrition, which toner contained 92.5 percent by weight of a styrene butadiene copolymer containing 90 percent by weight of styrene and 10 percent by weight of butadiene obtained from Goodyear Chemicals Corporation as PLIOTONE®, 5.0 percent by weight of Cabot REGAL 330®carbon black, 0.5 percent by weight of CPC, and 2.0 percent by weight of BONTRON E-84®. Micronization in a Sturtevant micronizer enabled toner particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns. The resulting toner particles obtained had an average volume size, or diameter of 9 microns.

Subsequently, there was added to the resulting toner particles surface by blending in a Lodige blender 0.3 percent by weight of Degussa AEROSIL R972® hydrophobic negatively charging silica, and 0.3 percent by weight of zinc stearate.

About three parts of the above prepared toner and 100 parts of carrier were admixed to provide a developer. The carrier particles were comprised of a 98 micron Hoeganese unoxidized steel grit core solution coated with 1.06 weight percent of an 80/20 (80 weight percent, and 20 weight percent) lacquer of polymethylmethacrylate/VULCAN 72R® carbon black.

The toner triboelectric charge was a negative −22 microcoulombs per gram at 3.02 toner concentration as determined by the known Faraday Cage method. The developer breakdown potential in volts was 40, and for detoned carrier the breakdown voltage was 24; the developer conductivity was $1.5\times10^{-10}$ (ohm-cm)$^{-1}$ and $1.3\times10^{-6}$ (ohm-cm)$^{-1}$ for detoned carrier as determined by the Gutman Cell, reference U.S. Pat. No. 5,196,803, the disclosure of which is totally incorporated herein by reference. The developer alpha, reference U.S. Pat. No. 4,513,074, entitled Stable Conductive Developer Compositions, was an acceptable 3.1. It is preferred that alpha be small, for example 5 or less, and more preferably 1 to about 3. The toner admix was 15 seconds as determined in the known charge spectrograph.

The aforementioned developer composition was utilized to develop latent images generated in a Xerox Corporation hybrid scavengeless test printer apparatus at a rate of 135 prints per minute, followed by the transfer of the developed images from a layered organic flexible photoreceptor comprised of an aluminum substrate, thereover a photogenerating layer comprised of a photogenerating pigment of trigonal selenium, and as a top layer a charge transport layer comprised of aryl diamine molecules of N,N'-bis(3"-methylphenyl)-1,1'-biphenyl-4,4'-diamine dispersed in MAKROLON®, a polycarbonate resin obtained from Larbensabricken Bayer A. G., prepared as disclosed in U.S. Pat. No. 4,265,990, the disclosure of which is totally incorporated herein by reference, to a paper substrate, and the images were fused to paper for 10,000 copies, each with from 4 to 30 percent area coverage. The developer charging properties remained essentially constant throughout the test, as determined by periodic measurements of toner triboelectric charge and toner concentration in the developer. The values of, for example, $A_r$ remained constant, about 130, throughout this test as determined from the following calculation, that is the product of one plus the toner concentration (TC) multiplied by the charge Q/M, for example 23 microcoulombs per gram.

$A_t=(1+TC)Q/M$

The fused images were of excellent quality, and possessed high optical densities of greater than 1.3 (solid area image optical density) as measured on a Macbeth Densitometer, and very low development of toner in background areas, that is minimum background deposits. Periodic visual microscopic inspection of the photoreceptor indicated no evidence of toner impacting onto the wires, such as in small streaks of one millimeter or less, that is there was an absence of undesirable wire contamination for the 10,000 print run. Further, there was an absence of negative ghosting (donor roll reload defect) in the prints showing a maintenance of acceptable developer conductivity during the print run. At the end of the print run, the conductivity was 3.4 E-12 and alpha of 2.5.

Other modifications of the present invention may occur to those skilled in the art subsequent to a review of the present application, and these modifications, including equivalents thereof, are intended to be included within the scope of the present invention.

What is claimed is:

1. A method for avoiding toner impaction onto development wires present in a xerographic imaging method consisting essentially of providing a xerographic imaging apparatus containing an imaging member, formulating an electrostatic latent image on said imaging member, affecting development thereof with a developer consisting essentially of carrier particles and a toner composition consisting essentially of resin particles, and pigment particles, and which composition includes thereon a surface additive mixture of silica or titanium dioxide, metal salts of fatty acids, and an aluminum complex, and thereafter transferring the developed image to a suitable substrate with said development wires, and wherein each of said silica or titanium dioxide, said metal salts of fatty acids, and said aluminum complex are present in an amount of from about 0.01 to about 2 weight percent, and wherein said aluminum complex is tris (3,5-di-tertiary-butyl salicylato) aluminum.

2. A method in accordance with claim 1 wherein the toner includes a surface additive mixture of silica, metal salts of fatty acids, and said aluminum complex.

3. A method in accordance with claim 2 wherein the surface additive of silica and metal salt are individually present in an amount of from about 0.02 to about 1 weight percent, and the surface additive of aluminum complex is present in an amount of from about 0.03 to about 0.07 weight percent.

4. A method in accordance with claim 1 wherein the pigment particles are cyan, magenta, and yellow pigments.

5. A method in accordance with claim 1 wherein the pigment particles are present in an amount of from about 1 to about 15 weight percent.

6. A method in accordance with claim 1 wherein the pigment particles are present in an amount of from about 2 to about 10 weight percent.

7. A method in accordance with claim 1 wherein the resin particles are styrene acrylates, styrene methacrylates, styrene butadienes, or polyesters, and wherein the toner maintains its At and its conductivity for up to about 100,000 imaging cycles, and the number of copies produced per minute was from about 100 to about 140, and wherein there were selected for transfer corotron wires, which wires were substantially free of contamination.

8. A method in accordance with claim 7 wherein the resin particles are present in an amount of from about 70 to about 90 weight percent.

9. A method in accordance with claim 1 wherein the resin particles are styrene acrylates, styrene methacrylates, styrene butadienes, or polyesters.

10. A method in accordance with claim 1 wherein the surface additive of silica and metal salt are individually present in an amount of from about 0.02 to about 1 weight percent, and the surface additive of aluminum complex is present in an amount of from about 0.03 to about 0.07 weight percent.

11. A method in accordance with claim 1 wherein the surface additive is present in an amount of from about 0.02 to about 1 weight percent.

12. A method in accordance with claim 1 wherein the silica is present in an amount of from about 0.3 to about 0.4 weight percent.

13. A method in accordance with claim 1 wherein the aluminum complex is present in an amount of from about 0.3 to about 0.4 weight percent, and the titanium dioxide is present in an amount of from about 0.8 to about 1 weight percent.

14. A method in accordance with claim 1 wherein the metal salts are zinc stearate.

15. A method in accordance with claim 1 wherein the toner size is from about 6 to about 20 microns in average volume diameter.

16. A method in accordance with claim 1 wherein the toner size is about 11 microns in average volume diameter.

17. A method in accordance with claim 1 wherein the toner tribo is from about 10 to about 40 microcoulombs per gram; the $A_t$ of the toner is stable; and transfer is accomplished with corotron wires, and wherein the wires are free, or substantially free of toner contamination.

18. A method in accordance with claim 1 wherein image transfer is accomplished with corotron wires, and wherein the wires are substantially free of contamination.

19. A process in accordance with claim 1 wherein the pigment is cyan and the metal salt of fatty acid is zinc stearate present in an amount of 0.3 weight percent, the silica is present in an amount of 0.3 weight percent, the titanium dioxide is present in an amount of 0.9 weight percent, and the aluminum complex is present in an amount of 0.05 weight percent.

20. A process in accordance with claim 1 wherein the pigment is magenta, the metal salt of fatty acid is zinc stearate present in an amount of 0.4 weight percent, the silica is present in an amount of 0.4 weight percent, titanium dioxide is present in an amount of 0.9 weight percent, and the aluminum complex is present in an amount of 0.1 weight percent, and which aluminum complex is tris (3,5-di-tertiary-butylsalicylato) aluminum.

21. A method for avoiding toner impaction onto development wires present in a xerographic imaging apparatus consisting of providing a xerographic imaging apparatus containing development wires therein, formulating an electrostatic latent image on a layered photoconductive imaging member, affecting development thereof with a developer consisting of carrier particles and a colored toner composition comprised of resin particles and pigment particles of cyan, magenta, yellow, or mixtures thereof, and which composition includes thereon a surface additive mixture of silica, metal salts of fatty acids, and an aluminum complex, transferring the developed image to a suitable substrate with said development wires, and fixing the image thereto, and wherein each of said silica metal salts of fatty acid and aluminum complex are present in an amount of from 0.01 to about 2 weight percent, wherein said aluminum complex is tris (3,5-di-tertiary-butylsalicylato) aluminum, and said toner possesses a narrow $A_t$ of from about 60 to about 95.

22. A method in accordance with claim 21 wherein the silica exhibits a BET surface area of about 150 $m^2$/gram, and said silica has been optionally treated with a coating of N-2-aminoethyl-3-aminopropyl trimethyl silane and dimethyldichlorosilane.

23. A method for avoiding toner impaction onto development wires present in a xerographic imaging apparatus consisting of providing a xerographic imaging apparatus containing development wires therein, formulating an electrostatic latent image on a layered photoconductive imaging member, affecting development thereof with a developer consisting of carrier particles and a toner composition comprised of resin particles and pigment particles of cyan, magenta, yellow, or mixtures thereof, and which composition includes thereon a surface additive mixture of titanium dioxide, metal salts of fatty acids, and an aluminum complex, transferring the developed image to a suitable substrate with said development wires, and fixing the image thereto, and wherein each of said silica, said metal salts of fatty acid and said aluminum complex are present in an amount of 0.4 weight percent and 0. 1 weight percent for said aluminum complex, wherein said aluminum complex is tris (3,5-di-tertiary-butylsalicylato) aluminum, and said toner possesses a narrow $A_r$ of from about 60 to about 95.

24. A process for minimizing or avoiding contamination of development wires utilized for transfer in a xerogrephic imaging method, which process consists of providing a photoconductive imaging member with a charge transport layer and a photogenerating layer, generating an electrostatic latent image on the imaging member, effecting development thereof with a developer, composition consisting essentially of carrier and a toner composition containing resin particles and pigment particles, and which cornposition includes on the surface thereof silica or titanium dioxide, zinc stearate, and an aluminum complex, and wherein the aluminum complex is tris (3,5-di-tertiary-butylsalioylato) aluminum, thereafter transferring the developed image to a suitable substrate, the improvement residing in selecting said silica, or said titanium dioxide, said zinc stearate, and said aluminum complex in an amount of from about 0.01 to about 2 weight percent, and wherein said development effects such transfer and wherein said development wires are free of toner contamination.

* * * * *